United States Patent [19]

Tsoutsas

[11] 4,188,603

[45] Feb. 12, 1980

[54] INDUCTOR WITH CONDUCTING CORE OF SINTERED POWDERED METAL

[75] Inventor: Peter A. Tsoutsas, Orland Park, Ill.

[73] Assignee: Permacor, Inc., Oak Lawn, Ill.

[21] Appl. No.: 928,063

[22] Filed: Jul. 26, 1978

[51] Int. Cl.[2] ..... H01F 21/04

[52] U.S. Cl. ..... 336/75; 428/553; 428/555

[58] Field of Search ..... 336/73, 75, 77, 79, 336/136, 130; 428/553, 555; 75/249; 29/606, 630 C

[56] References Cited

U.S. PATENT DOCUMENTS

| | | | |
|---|---|---|---|
| 2,403,349 | 7/1946 | Dolberg | 336/75 X |
| 3,346,951 | 2/1966 | Gwyn, Jr. | 29/630 C |
| 3,388,362 | 6/1968 | Raffaelli | 336/73 |
| 3,564,708 | 2/1971 | Harris | 29/606 |
| 3,719,902 | 3/1973 | Esterly | 336/73 X |
| 3,947,934 | 4/1976 | Olson | 336/200 X |
| 4,010,536 | 3/1977 | Fujita et al. | 336/73 |
| 4,034,325 | 7/1977 | Zarkov | 336/75 |

OTHER PUBLICATIONS

"Porous Aluminum Bearings," S. St or Chheim, Product Engineering, Apr. 2, 1962, pp. 53–55.

*Primary Examiner*—Thomas J. Kozma

[57] ABSTRACT

A sintered powdered aluminum core for an inductor used in the tuning stages of high frequency equipment is disclosed. Such cores have threads ground on them having sharp thread profiles, as opposed to the flat thread profiles produced by screw machines, and plating the cores produces superior electrical properties.

5 Claims, 8 Drawing Figures

FIG. 1
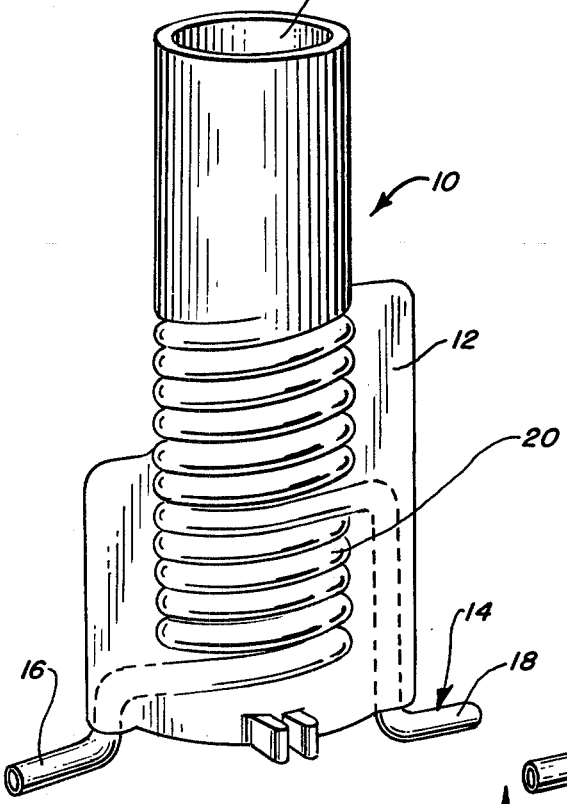
FIG. 2
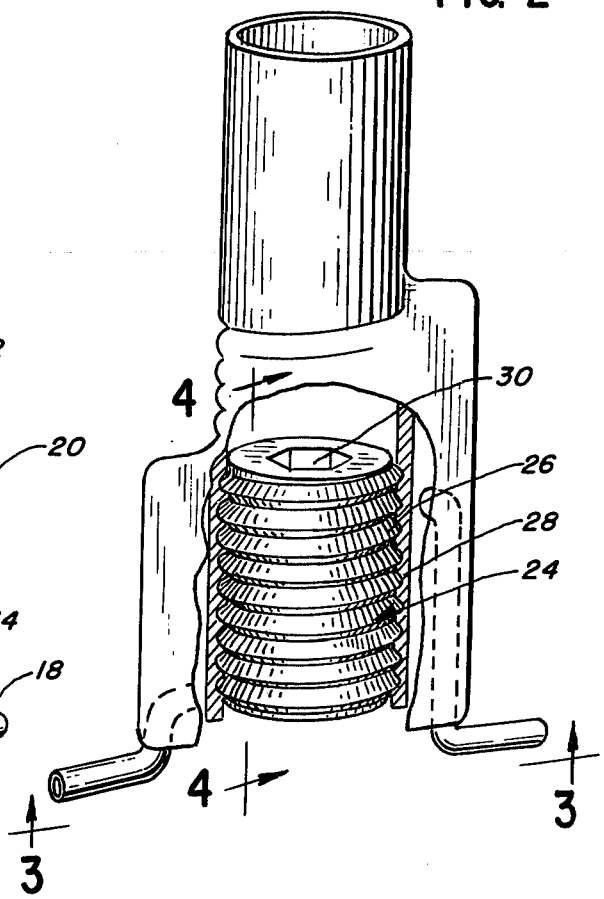
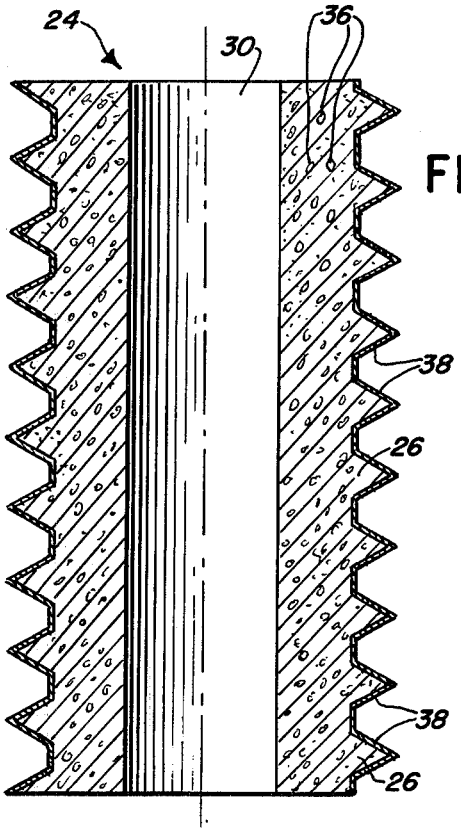
FIG. 4
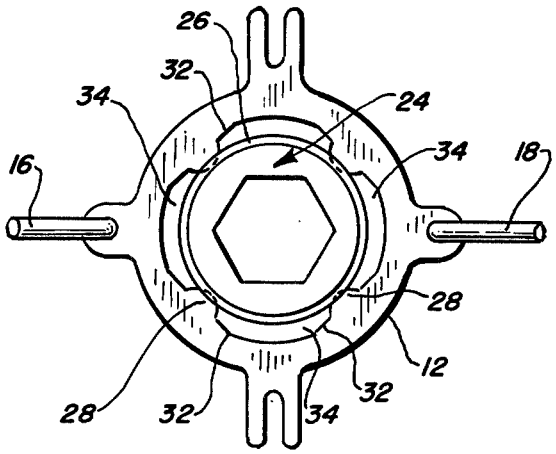
FIG. 3

B
40
C
D
A
38
E
42
F

B
40
C
D'
A
38
E'
42
F

INDUCTOR WITH CONDUCTING CORE OF SINTERED POWDERED METAL

This invention relates to metallic inductor cores for inductor coils used in the tuning stages of high frequency equipment. More especially it relates to cores made of sintered powdered aluminum having sharp thread profiles. Such cores are normally plated with good conductors to produce superior electrical properties.

The normal structures in which inductor cores have heretofore been used were coil forms usually made of plastic. The inductor coils were wrapped around the plastic form, or variously embedded in it, to establish a number of turns. A centrally located aperture through the coil form permitted the core to be inserted. Usually threads were formed on the outside of the core to engage the walls of the aperture in the coil form, and such an arrangement permitted the core to be adjustably disposed and fixed in place inside the turns of the coil. Although in low frequency circuits it was not necessary to make finely tuned adjustments, that is, to be especially concerned with the exact positioning of the core inside the coil, high frequency circuits posed definite tuning problems, both mechanical and electrical, using the means heretofore at hand.

Inductor cores of the general type here involved were utilized which were either made of iron or predominantly of ferromagnetic materials or, sometimes, of aluminum or brass. The threads on the outside of the cores were cut on screw machines, and the cores thereafter positioned inside the inductor coils by tapping them into centrally located apertures in the plastic coil forms. While the size of the coil forms and inductor cores has varied considerably over the years, a typical length for a core has been about ⅜", and the outside diameter about ¼".

In order to apply a proper degree of torque to the cores while they were being inserted in the coils, and to adjust the position of the cores for tuning purposes after insertion, a tool receiving formation, such as a hexagonally-shaped aperture for an Allen wrench, or a captive slot for a small screwdriver, was made in at least one end of the cores. Also, since the engagement of the core threads on inside walls of the coil form would necessarily displace coil form material, the threads were arranged to engage ribs or similar protrusions extending inwardly from the aperture walls. Displacement of coil form material, by the core threads, would then only be from the faces of the ribs, and the displaced material was thus disposed beside the ribs in cavities between the threads and the aperture walls. The torque applied to the cores was thereby brought within difficult but permissible limits so that neither the coil forms nor the cores would be destroyed, and the cores could then be tapped into the coil form apertures.

Several drawbacks attended the use of cores on which the threads had been formed by cutting metal away from a core blank on a screw thread making machine. It was extremely difficult, for example, to maintain a uniform thread profile from piece to piece and batch to batch. In an attempt to increase uniformity of pitch and profile, the threads cut on the screw machine were kept low and made somewhat broad, and their peaks especially were made wide and broad, not sharp and thin. The non-uniformity and flat peaks of the threads were evident in observing cross sections of the threads.

Such thread formations also resulted frequently in the need to recycle the cores as they were installed in the coil forms: the cores would be started in the coil form apertures; but they would soon be squeezed so tightly, and the torque would become so great to turn them, that they would have to be backed off. Then they would be screwed into place again. Sometimes the recycling process was necessary to repeat three or four times until the core was completely and properly screwed into the coil form.

In order to combat the problems of flat threads and non-uniform thread profiles the users to such cores frequently tried to make variations in the sizes of the coil forms. Such an alternative was undesirable but necessarily acceptable as a variable in a tuned circuit. The high cost of retooling to change the size of the coil forms was also recognized as a necessary but undesirable factor.

Difficulties were encountered in making the tool receiving formation in the core. A hexagonal aperture could be broached in bar stock, but it was necessary to eliminate the burrs formed on the ends of the core which were left by the broaching tool. Also, the uniformity of the diameter of the core was frequently violated during the broaching process, or, if the formation of the threads was performed last, the integrity of the aperture was often lost. It was found that broaching the aperture in cores longer than about ⅜" was commercially impractical due to the malformities created in the broaching process.

Using screw threading machines to make the threads was expensive, both in terms of equipment operating costs and in terms of time to cut the threads. The set-up costs were such that to make small amounts of cores, just a few thousand, was prohibitively expensive, and normally quantity advantages could not be achieved under approximately half a million cores.

There have been, therefore, recognized problems in inductor core manufacture and use. Ferromagnetic cores affected the tuning of the coils in a gross manner. Slight changes, in other words, in the disposition of the cores within the inductor coils made vast changes in the inductance of the coils, and coils with such cores were not well suited for use in high frequency circuits. Moreover, the inductance which they produced in the coils was positive, i.e., considering the initial inductance of the coil without any core as the starting point, inductance of the coil was increased as the core was inserted.

It was recognized also that aluminum cores threaded on screw machines possessed electrical properties which permitted much finer tuning of the coils. The movement of these cores within the coils produced less fluctuation in inductance than the degree of fluctuation produced by corresponding degrees of movement of ferromagnetic cores. Also, aluminum cores produced permeability less than unity: the initial inductance of the coil without the core, that is, an "air core," was decreased as the aluminum core was inserted, so that when the core was fully inserted the inductance of the coil was decreased. The aluminum cores were therefore better adapted for resonance with their associated capacitors, but the core construction problems heretofore stated were a substantial drawback to their use.

It is an object of the present invention to provide a core for use in an inductor coil in a tuned high frequency circuit, which core is readily assembled with the body of the coil form containing the inductor coil.

It is another object of the present invention to provide a core for use in an inductor coil in a tuned high frequency circuit, which core is mechanically and electrically adjustable in small increments inside the body of the coil form containing the inductor coil.

It is another object of the present invention to provide a core for use in an inductor coil in a tuned high frequency circuit, which core is provided with threads on its outer surface having a sharp and uniform thread profile.

It is another object of the present invention to provide a core for use in an inductor coil in a tuned high frequency circuit, which core is movable inside the body of the coil form containing the inductor coil to adjust the inductance of the coil in a range below the amount of the coil's inductance without any core, but also to produce substantially fewer losses than the use of a core of solid aluminum bar stock.

It is another object of the present invention to provide a core for use in an inductor coil in a tuned high frequency circuit, which core is readily formed without burrs or other objectionable malformations in the process of forming a tool receiving aperture or engagement means in the core.

It is still another object of the present invention to provide an inductor comprising the combination of a coil and core for a tuned high frequency circuit, the inductor providing less inductance than air at a pressure of one atmosphere, and being less expensive and more reliable than prior inductors which incorporated cores made of aluminum bar stock.

These and yet additional objects and features of the invention will become apparent from the following detailed discussion of an exemplary embodiment, and from the drawings and appended claims.

In a preferred form of the present invention an inductor body is provided with a winding forming a plurality of helical turns disposed about the body and a core of sintered powdered metal disposed in the body, the inductance of the inductor thus furnished being less than the inductance thereof without the core.

BRIEF DESCRIPTION OF THE DRAWINGS

For a complete understanding of this invention reference should be made to the accompanying drawings in which:

FIG. 1 is a perspective view of an inductor for use in a tuned high frequency circuit, the windings of the inductor coil being partially evident on the outside of the inductor body, and the leads to the coil being shown partly in dotted lines;

FIG. 2 is a perspective view, partly broken away, of the inductor shown in FIG. 1;

FIG. 3 is a plan view, taken in the direction of arrow 3 in FIG. 1, of one end of the inductor shown in FIG. 1;

FIG. 4 is an enlarged cross-sectional view of the inductor core shown in FIG. 2, taken in the direction of arrows 4—4 in FIG. 2;

DETAILED DESCRIPTION OF THE PREFERRED EMBODIMENT

Figure 5:
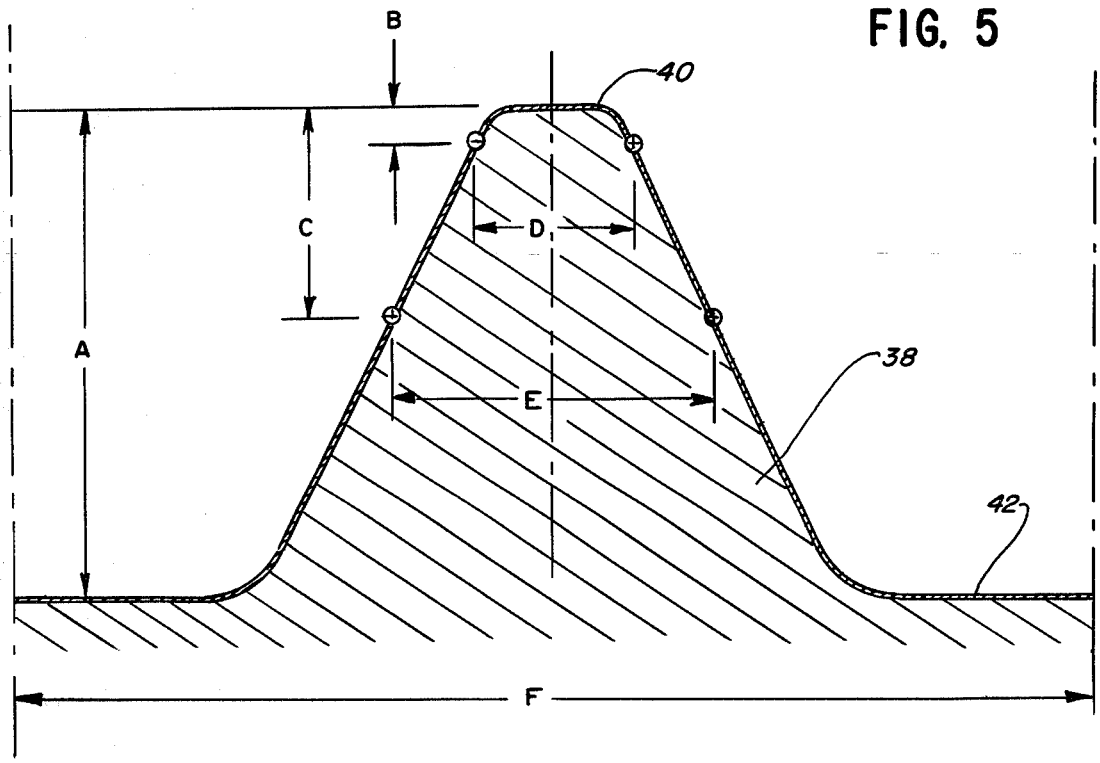
FIG. 5 is an enlarged cross-sectional view, or profile, of one of the threads of the core shown in FIG. 4.

A form of inductor 10 for use in a tuned high frequency circuit is shown in FIG. 1. The inductor body, or coil form, 12 may be of any configuration suitable for use in the circuit assembly of which the inductor is a part, and the illustrated form is merely one which happens to have a present, practical configuration. Normally the body 12 is made of a firm, molded plastic material.

A conductor 14 is partially embedded in the inductor body 12 at the time the body is molded. The conductor 14 includes the leads 16 and 18 and a winding consisting of a plurality of helical turns 20 disposed about the body. A centrally located aperture 22 in the body 12 extends through the body and is surrounded by the turns 20.

Inside the coil form, within the central aperture 22, a core 24 is assembled with the coil form to make up the inductor 10. Core 24 has a means for positioning the core inside the aperture 22, namely, threads 26 which engage ribs 28 inside the coil form body. There is a hexagonally shaped central aperture 30 in core 24 suitable for receiving a tool such as a hexagonally shaped wrench. While the aperture may be of any shape, such as triangular, to fit a wrench to turn the core, other tool receiving means may be utilized. One such means is a captive slot (not shown) for a screwdriver. On the core 24 of the instant invention the threads 26 have a sharp and uniform thread profile, a configuration which permits the tips of the threads to bite into the ribs 28 and readily move the core 24 into the portion of aperture 22 inside the helical turns 20 in a self-tapping manner.

As shown in FIG. 3, when the threads 26 engage the ribs 28 inside the inductor body 12, the threads are spaced away from the inside walls 32 of the inductor body. The enclosed pockets 34 which are formed in this manner between the ribs 28, the threads 26 and the walls 32 afford spaces for storing plastic material from the faces of the ribs as the threads 26 displace it during the self-tapping installation of core 24. If the pockets 34 were not provided for, the threads of the core would quickly become so tightly bound that torque for inserting the core would pass all practical limits and the dimensional integrity of the inductor body would be destroyed.

The core 24 which is shown in FIG. 2 is shown in enlarged cross-section in FIG. 4. It is made of powdered aluminum which has been sintered, thus producing a large number of voids among the metal particles such as shown at 36. These voids occur throughout the core, both internally and at the surface of the core. Hexagonally shaped aperture 30 extends clear through the length of the core, although the precise configuration of such aperture and its length can be left up to any design parameters to be established for particular applications. Threads 26 disposed on the outside of the core are sharp-pointed due to the fact that they can be ground readily in the sintered aluminum. In some cores sintered brass powder has been used, and sharp pointed threads may be achieved by thread grinding in such constructions also.

It has been found that the electrical properties of the core 24 can be surprisingly improved by plating the threads from end to end of the core with a conductive metal such as shown at 38. Such plating, when the core is made of sintered aluminum powder, is made up of two layers, the first or base layer being of copper which adheres readily to the aluminum and the second being of gold or silver which adheres well to the copper. Bright acid tin may also be used for the outer surface layer. The approximate thickness of the entire plating layer 38 is normally on the order of 0.0005 of an inch.

Figure 6:
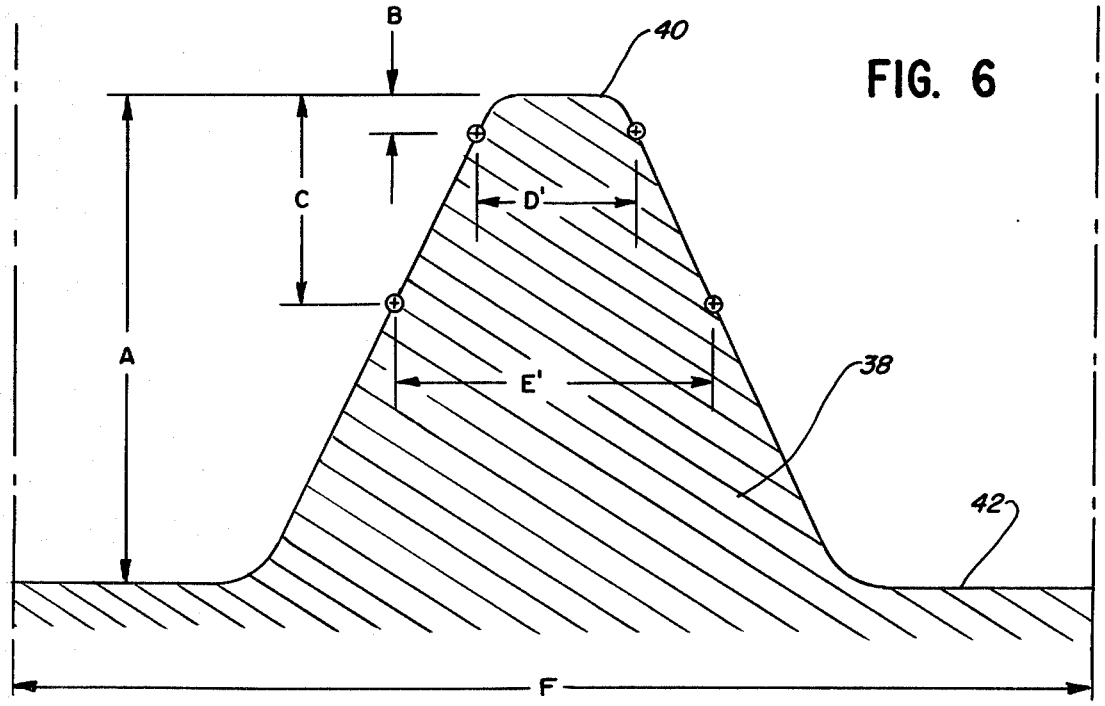
FIG. 6 is an enlarged cross-sectional view of a modified form of one of the threads shown in FIG. 5.

Both the plated and unplated sintered aluminum powdered metal forms of core 24 have sharp thread profiles, as shown in FIGS. 5 and 6. In both figures the pitch of the threads, dimension F, is the same, and is normally about 0.0315 of an inch in practice. Peak 40 of thread 38 is normally about 0.014 of an inch above the valley 42 between adjacent threads, the height of peak 40 being shown as dimension A in both FIGS. 5 and 6. Tolerance limits of the sharp edge of the threads is normally taken at 0.001 of an inch below the uppermost extremity of peak 40, and also at a distance of 0.006 of an inch below the uppermost extremity, dimensions B and C, respectively in FIGS. 5 and 6. For the sintered and plated thread shown in FIG. 5, formed by grinding the thread on a sintered powdered aluminum core, the cross-sectional width D of the thread at dimension B can be readily held in practice to about 0.005 inches, and the cross-sectional width E to about 0.010 inches. Prior to plating, these same cross-sectional widths in the same core construction, which are shown at $D^1$ and $E^1$ in FIG. 6, can readily be held to 0.0045 of an inch and 0.0095 of an inch, respectively.

Figure 7:
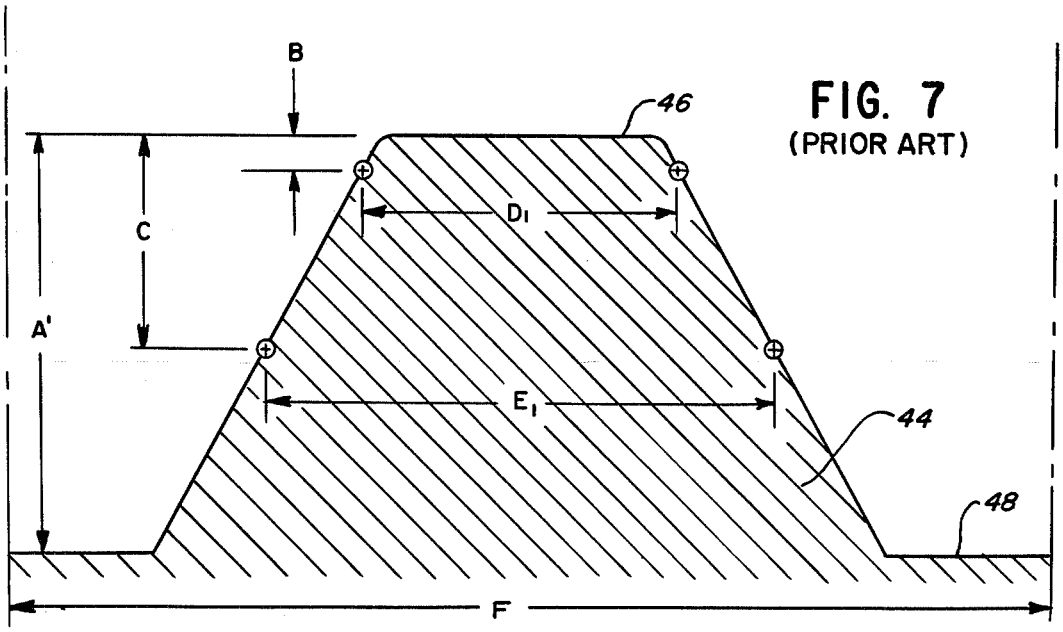
FIG. 7 (PRIOR ART)
FIG. 7 is an enlarged cross-sectional view, or profile, of a prior art thread not otherwise shown in the drawing.

For comparison, the cross-sectional profile of threads obtainable by removing material from an aluminum core blank (normally a piece of bar stock) with a screw threading apparatus is shown in the profile of a prior art thread 44 in FIG. 7. The peak 46 is demonstrably broad and flat and is situated in practice at about 0.012 of an inch above valley 48 at the base of the thread. The pitch of thread 44 is the same dimension as that of thread 38 in FIGS. 5 and 6 and is shown as dimension F in all three figures of the drawing. The height of peak 46 above valley 48 is shown as dimension $A^1$ in FIG. 7, comparable to but 0.002 of an inch shorter than dimension A in FIGS. 5 and 6.

The breadth of the cross-section of thread 44 compared to that of thread 38 is also apparent in the comparison of widths $D_1$ and $E_1$ which are taken at identical distances B and C, respectively, below peak 46 as widths D and E in FIG. 5. In practice it has been found that threads formed on the screw thread machine have a cross-sectional width at dimension $D_1$ of 0.009 of an inch, and a cross-sectional width at dimension $E_2$ of 0.015 of an inch. A direct dimensional comparison of the actual threads presently in use makes it evident that the cross-sectional width of the threads of the new core is 0.005 of an inch, or 5 mils, thinner at dimension E which is 0.006 of an inch below the peaks of the threads, and 0.004 of an inch, or 4 mils, thinner at dimension D which is 0.001 of an inch below the peaks of the threads.

The significance of the dimensional differences set forth in exemplary terms above is that far less torque is required to screw the new cores into the inductor bodies and the sharper threads cut the ribs more readily and displace less plastic material. The decrease in torque is also achieved by providing a greater uniformity of peak and valley configurations in the thread profile of the new cores.

One powdered aluminum used in making the new cores is a minus thirty mesh powdered metal obtainable as grade MD-69 from Alcan Metal Powders, Division of Alcan Aluminum Corporation. Other grades of powdered aluminum have been used, and although they have been found to produce improved cores, within the scope of the present invention, their electrical properties were not as good as MD-69. To make the new cores, such powdered metal as MD-69, or a similar grade, is compacted in a well-known manner in a die formation to create a metal cylinder. A central opening, such as hexagonal aperture 30, is also formed at this time by compacting the powdered metal around a rod of any preferred shape. The green cores thus formed have sufficient internal cohesion to withstand handling, and they are thereupon moved to a sintering step wherein they are heated for about thirty minutes at temperatures on the order of 590° C. to 625° C. After the core blanks are sintered, they are moved into a thread grinding apparatus wherein they are moved past a thread grinding wheel or rod. Normal processing in the thread grinding stage produces cores with freshly ground threads having the above-described dimensions at rates on the order of 25,000 $\frac{3}{8}$ inch cores per hour. The new cores are then plated with conductive metal coatings in a well-known manner to accomplish the plating layer above described.

Whenever different lengths of cores are desired, or different diameters than the $\frac{1}{4}$ inch O.D. core described particularly above, or a different thread size than that of the current thread grinding wheel, very little effort is required to change the dies in the compacting press and the size of the grinding rod or wheel. Small quantities of cores having close thread tolerances are therefore feasible without incurring substantial set-up costs. Small quantities can also be made at a high rate of speed, thereby utilizing only a small amount of press time and thread grinding time.

While it is evident that the advantages of making a high volume of more uniformly threaded cores make the new cores most desirable, it has been found further that the plating step provides cores having electrical properties substantially superior to the bar stock cores heretofore used. Plated aluminum cores of the present invention have been found to have a tuning range, for example, of about 2 to 1. The inductance, in other words, of the coils in which they have been inserted can be varied, when the cores are fully inserted in the windings, to about one-half of the inductance which they possessed when they contained no core at all.

Figure 8:
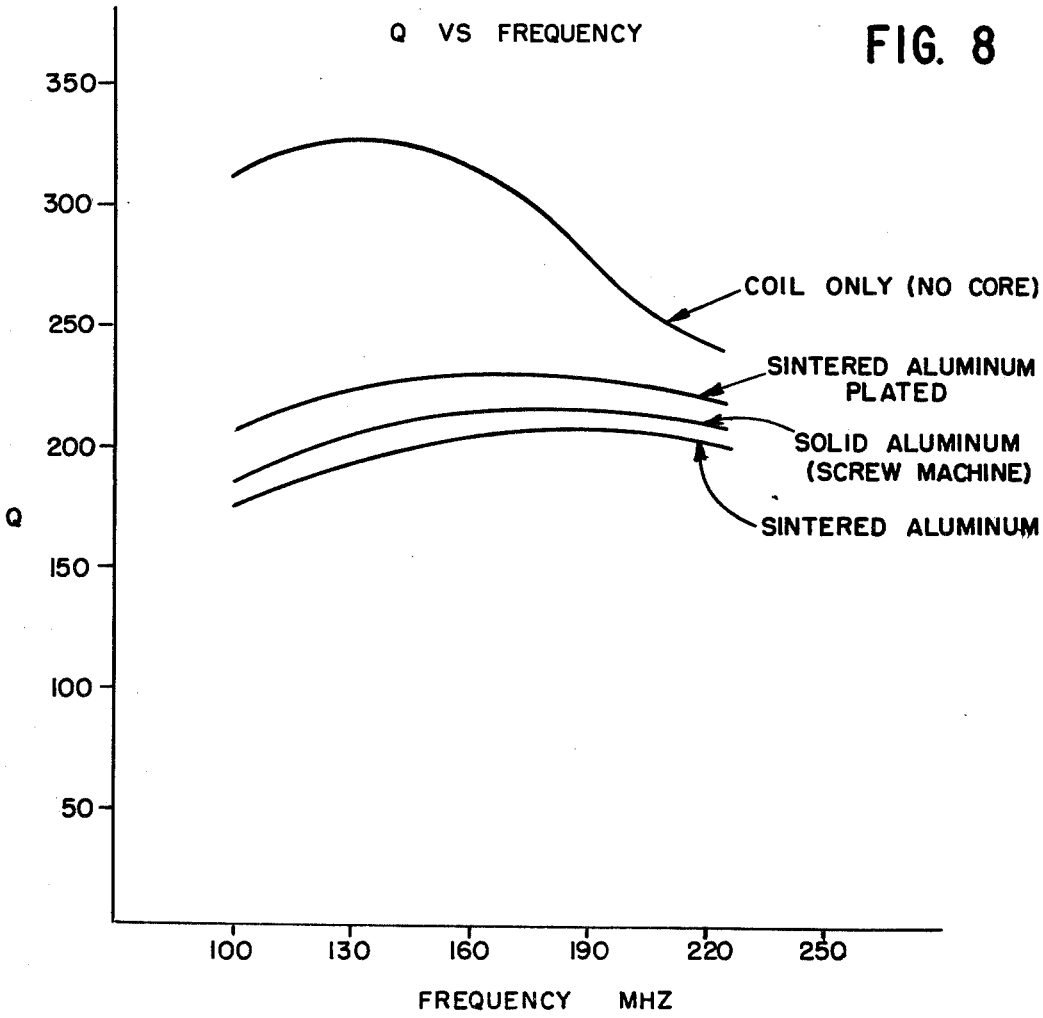
FIG. 8 is a graphic comparison of the control of electrical losses at various input frequencies by four forms of the coil shown in FIG. 1, said four forms differing only in the form of core present inside the coil or, in one instance, not used.

FIG. 8 also demonstrates the superiority of cores of the present invention by plotting certain differences in electrical properties that were determined in comparing the functional losses of inductors utilizing coils which were provided with various cores. The range of testing covered by the chart was all done in the high frequency range of 100 to 250 megacycles. The capacity was adjusted to keep the resonance frequency.

On the vertical axis of the graph in FIG. 8, various levels of loss activity of the tested coils were charted in terms of a "Q" factor measured on a Boonton Radio 190 Q Meter. As noted on the chart, the top graph depicts the activity of a coil only, one which had no core. The next lower graph depicts the activity of a coil provided with a sintered powdered aluminum core which was plated with a conductive metal, in this case, with silver.

The next lower graph depicts the activity of a coil provided with a core made of solid aluminum, not a sintered core of the present invention, having threads made on a screw thread-cutting machine. The lowest graph depicts the activity of a coil provided with a sintered aluminum core which was unplated.

It should be understood in reading the chart of FIG. 8 that a high Q reading is desirable because it indicates a high inductance in the coil. A low Q reading indicates greater electrical losses and, in certain respects, a less desirable inductor. In this sence, the absence of any core in the coil will give a high Q reading due to the high degree of permeability of the air in place of the core inside the coil. However, it is also necessary to observe that the absence of any core precludes any ability to tune the inductor to resonate with a capacitor in a tuned high frequency circuit.

In testing the coil without any core, according to the top graph in FIG. 8, it was first observed that the coil was in resonance at an input frequency of 100 megacycles. The initial Q response showed a reading on the Boonton meter of 310. As the frequency of the input to the inductor was initially increased, the Q response rose to a maximum reading, i.e., the least amount of losses, of about 327 at about 127 to 138 megacycles. Thereafter, although the frequency was further increased, the Q reading decreased rather steadily, as shown, to a reading of 242 at a frequency of about 226 megacycles.

A silver plated sintered powdered aluminum core was installed next in the coil which had just been tested without a core. The results of testing the coil with the new core are shown in FIG. 8 in the graph next to the top. The core was initially adjusted so that the coil was in resonance at the same input frequency as the coil alone had been previously, namely, at 100 megacycles. At that frequency the Q reading of the losses was about 205, thus showing that the tuned coil was affecting by utilizing the core to tune it, and also showing that its permeability with the core installed was considerably less than its permeability in air without any core. As the frequency was increased the Q reading rose, and the losses decreased, to a maximum reading of about 230 at a frequency input from about 163 megacycles to about 184 megacycles. Thereafter, as the frequency was increased, the Q reading dipped to about 220 at a maximum frequency of about 226 megacycles.

The silver plated core just described was removed from the coil, and in its place a solid aluminum core, made from aluminum bar stock and threaded on a screw machine, was substituted. Initial tuning of the coil at an input frequency of 100 megacycles showed that it was in resonance at a Q reading of 185 on the Boonton meter. As the frequency was increased, the Q reading rose until it reached a maximum of about 217 for the range of about 172 megacycles to 190 megacycles. Thereafter, the Q response dropped as the frequency was increased so that the Q reading on the Boonton meter was about 209 at 226 megacycles.

The bottom graph in FIG. 8 shows the results of using an unplated sintered aluminum core in place of either of the previous cores. The initial Q response, when the unplated core was adjusted to tune the coil, was 175 at a frequency of 100 megacycles. Thereafter, as the frequency was increased the Q response rose to about 208 in the range of 181 to 202 megacycles, and it dropped off to about 200 as the frequency was moved up to a maximum of 226 megacycles.

From the results of these tests it is apparent that the silver plated sintered powdered aluminum core demonstrated clear and substantial superiority in electrical properties. At each of the frequencies at which the coil peaked in its Q meter response to the various cores, the sintered and plated core displayed fewer Q meter losses. Using the approximate mid-point of the frequency ranges at which the coil peaked for each testing made, the superiority of the sintered and plated powdered aluminum core may be seen in the following chart of the graphs in FIG. 8:

| COIL Q RESPONSES | PEAK FREQUENCIES 133 | 175 | 181 | 193 |
|---|---|---|---|---|
| No core (untunable) | 327 | 300 | 295 | 275 |
| Sintered and Plated Al | 222 | 230 | 230 | 228 |
| Bar Stock Al | 204 | 216 | 217 | 216 |
| Al Sintered only | 192 | 208 | 208 | 208 |

Thus it will be seen that improvements have been provided in the formation of metallic inductor cores and the use thereof in high frequency circuits meeting the afore-stated objects.

While a particular embodiment of the present invention has been shown, it will be understood, of course, that the invention is not limited thereto since modifications may be made by those skilled in the art, particularly in light of the foregoing teachings. It is, therefore, contemplated by the appended claims to cover any such modifications as incorporate those features which come within the true spirit and scope of the invention.

What is claimed is:

1. An inductor comprising in combination
an inductor body,
a winding forming a plurality of helical turns disposed about the inductor body, and
a core disposed in the body and surrounded by the winding,
the core being formed of sintered aluminum powdered metal.

2. The inductor of claim 1 wherein the core is plated with a highly conductive metal.

3. An inductor comprising in combination
an inductor body
a winding forming a plurality of helical turns disposed about the inductor body and
a core of sintered powdered metal disposed in the body,
the inductance of said inductor being less than the inductance thereof without the core.

4. An inductor comprising in combination
an inductor body,
a winding forming a plurality of helical turns disposed about the inductor body, and
a core of sintered powdered metal disposed in the body,
the core being movable in a direction coaxial with the winding within the body, and
the inductance of said inductor being variable by movement of the core and less in all locations of the core within the body than the inductance thereof without the core.

5. An inductor comprising in combination
an inductor body
a winding forming a plurality of helical turns disposed about the inductor body, and
a core of sintered powdered metal disposed in the body,
the inductance of said core in said inductor being less than that of air at a pressure of one atmosphere.

* * * * *